United States Patent [19]

Bricker et al.

[11] Patent Number: 4,697,610

[45] Date of Patent: Oct. 6, 1987

[54] FAUCET PROPORTIONER

[75] Inventors: James C. Bricker, Waynesville; David H. Lippman, Cincinnati, both of Ohio

[73] Assignee: Hydro Systems Company, Cincinnati, Ohio

[21] Appl. No.: 919,782

[22] Filed: Oct. 16, 1986

[51] Int. Cl.[4] ..... F17D 1/00; F16K 24/00; E03C 1/046

[52] U.S. Cl. ..... 137/3; 137/216; 137/893; 137/897; 239/318; 417/186

[58] Field of Search ..... 137/1, 2, 3, 215, 216, 137/216.1, 217, 218, 888, 892, 893, 896, 897; 222/133; 239/310, 311, 318; 417/186

[56] References Cited

U.S. PATENT DOCUMENTS 2,056,357 10/1936 Luff ..... 137/216

2,405,639 8/1946 Boosey ..... 137/216

*Primary Examiner*—George L. Walton

*Attorney, Agent, or Firm*—Wood, Herron & Evans

[57] ABSTRACT

In a preferred embodiment an improved faucet proportioner includes a plate for defining a first stream of water together with additional curtain streams of water adjacent the first stream. The first stream is directed into a venturi for pulling a second liquid, like detergent or sanitizer, while the curtain streams flow alongside outside of the venturi, but within the proportioner. The streams first contain any splash or splatter of the first stream at the venturi mouth, and secondly the streams enhance the venturi drawing action of the first stream upon joining the first stream as it flows out of the venturi discharge opening. The enhanced venturi action of the first stream effectively draws the second liquid into the first stream, yet the proportioner does not require any porous obstruction downstream of the venturi which might clog or retain detergent or sanitizer and release it when only pure water is desired. Methods are included.

24 Claims, 5 Drawing Figures

FAUCET PROPORTIONER

This invention relates to the proportional mixing of two fluids, such as liquids, and more particularly to an improved faucet proportioner for accomplishing such mixing.

Faucet proportioners are well-known. Such devices are used to intermix one fluid, such as water running from a faucet with another fluid, such as a liquid detergent. In a typical device, the water from the faucet is directed through a venturi having a port connected to a source of liquid detergent. The velocity of the water creates a pressure drop at the port, sucking the liquid detergent into the water at the venturi. The liquids are discharged in a combined stream. Such a proportioner device is shown, for example, in U.S. Pat. No. 2,908,227.

Such devices presented a potential problem, however, in that upon the existence of a vacuum in the water system feeding the proportioner, water and detergent (or other liquids used) could be siphoned or sucked back up into the water system, contaminating it.

A "vacuum breaker" type solved this problem. In such vacuum breaker proportioners an air chamber, always open to atmosphere was disposed in the device upstream of the venturi. A stream of water was projected across this chamber into the venturi. Any vacuum in the system would simply suck air from this chamber, and not water or other chemicals, back into the conduits, thereby eliminating contamination of the system.

One such device is shown, for example, in U.S. Pat. No. 3,072,137. In that device, a splash skirt was disposed around the air chamber to direct any splash from the unit and the air chamber downwardly, and to prevent it from projecting laterally.

In another similar device, shown in U.S. Pat. No. 3,166,086, auxiliary passages alongside the venturi were added to provide for excess flow of water which did not flow through the venturi as a result of a relatively large volume stream being directed into a relatively small venturi passage. The flow of the excess water in one embodiment of such device was induced by the speed of the water exiting from the downstream end of the venturi. Nevertheless, the splash skirt was retained to capture splash.

The vacuum breaker proportioners, while useful, presented several further problems. First, it was very difficult to precisely align the orifice, across the air chamber, with the venturi mouth which was generally of similar size to the orifice. Manufacturing procedures falling short of the required precision led to misalignment, even the slightest of which caused splash and splatter of the stream on the venturi mouth in addition to any excess flow mentioned above.

Any splash or splatter at the mouth of the venturi was highly annoying. Such splatter would dribble down the outside of the unit and could spray outwardly in a pattern beyond a sink or bucket receptacle, for example.

Secondly, the action of the venturi, and its drawing efficiency, was inhibited by the abrupt opening or widening of the venturi passage at the port for the liquid detergent. The water stream flowing through the venturi tended to bridge over the port, only eventually tapering outwardly beyond the port to the widening venturi passage walls. This induced a certain amount of deleterious turbulence at the port, reducing the efficiency of the venturi to draw up the liquid detergent. In order to reduce this defect, the devices of the noted patents utilized screens or perforated plates at the proportioner discharge end. It is believed these porous obstructions created a back pressure or other phenomena within the venturi to somewhat reduce the turbulence at the port and increase its efficiency. Without such porous obstructions, the venturi drawing forces appear to be significantly reduced, or rendered ineffective.

Nevertheless, the use of screens or perforated plates present their own problems, such as clogging. Also, the screens or plates retain chemicals or detergents which can be flushed off upon subsequent operations. This can contaminate the effluent when no detergent or chemicals were desired.

Accordingly, it has been one objective of this invention to provide a faucet proportioner with means to reduce annoying splash and splatter.

A further objective of this invention has been to provide a faucet proportioner with an unobstructed discharge opening or passageway, while improving at the same time the efficiency and action of the venturi therein in drawing up a second fluid such as a liquid detergent or other liquid, for example.

A further objective of the invention has been to provide an improved vacuum-breaker faucet proportioner wherein splash and splatter are automatically self-contained.

A further objective of the invention has been to provide improved methods for intermixing two fluids in a proportioner, reducing splash or splatter therefrom, and improving the action of a mixing venturi therein.

To these ends, an improved faucet proportioner in a preferred embodiment includes a body, an intake chamber, an air chamber having outlets through the body to the atmosphere, a venturi, and passageways alongside said venturi extending to an end of said venturi and beyond to an unobstructed discharge opening from the body. An orifice plate is disposed between the intake chamber and the air chamber and includes an orifice defining a first stream of water, and directing the first stream into a mouth of the venturi. In addition, the orifice plate contains at least one, and preferably two, additional orifices or slots for establishing second and third streams, curtains or walls of water parallel to and adjacent the first stream. These second and third streams effectively surround the venturi mouth and capture or contain any splash or splatter from the first stream. Any such splash or splatter, or any excess water flow outside the venturi is carried with the streams through the passageways outside the venturi, but in the body, to the venturi outlet. At the outlet, the streams are combined, with the surprising effect of increasing the efficiency of the venturi in drawing a second liquid through a port located therein at a disposition where there is an abrupt widening of the internal venturi passage.

The exterior wall of the venturi is shaped like an air foil, with an enlarged section between its ends. The venturi tapers exteriorly inwardly toward an elongated venturi axis and in both upstream and downstream directions. This shape increases the velocity of the second and third streams with respect to the first stream running through the venturi, and enhances the effect of the venturi action in drawing the second fluid upon combining with the first stream.

Upon any vacuum in the water system feeding the proportioner, such as a transient vacuum in a water line for example, air is simply sucked backwardly through the air chamber and from there through the orifices or slots into the intake chamber and the feed line. There is no reverse liquid flow and thus no contamination of the feed system.

Accordingly, there is no annoying splash or splatter and the venturi sucking action is improved with no screen or other obstruction in the proportioner discharge.

These and other objectives and advantages will become readily apparent from the following detailed description of a preferred embodiment of the invention, and from the drawings in which.

Figure 1:
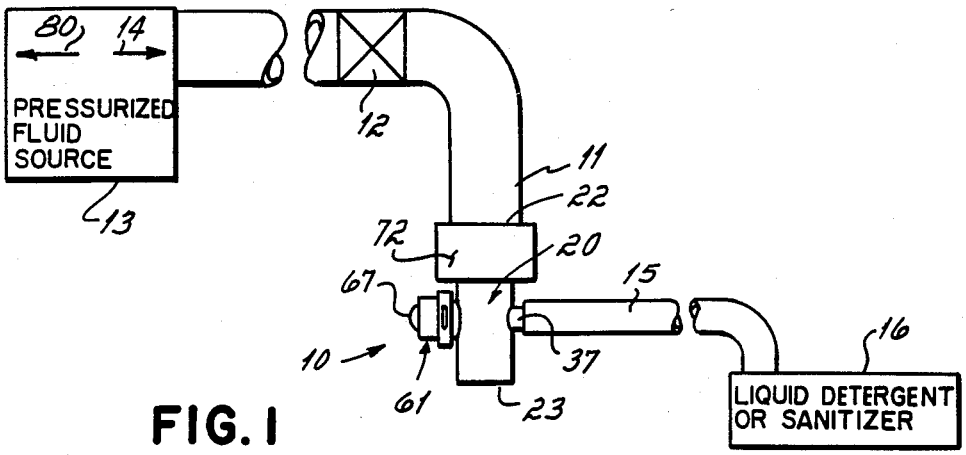
FIG. 1 is a diagrammatic elevational view of a faucet proportioner according to the invention and depicting the environment in which it is used.

Turning now to the drawings, there is shown in FIG. 1 a faucet proportioner 10 according to the invention and mounted to a faucet or conduit 11. Faucet 11 is connected through a valve means 12 to a source of fluid under pressure, such as for example, a municipal water supply 13 of pressurized water. Such a supply feeds water, in the direction of arrow 14, toward the valve 12 and faucet 11 for introduction into the proportioner 10. Proportioner 10 is operatively connected through a conduit 15 to a source 16 of a second fluid, such as a liquid detergent or sanitizer.

It will be appreciated that for purpose of this description, the proportioner will hereinafter be discussed with respect to use on a water faucet for intermixing water as a first liquid with a liquid detergent or sanitizer from source 16 as a second fluid or liquid. It should be appreciated that the proportioner 10 could be utilized in a variety of differing systems, for the purposes of intermixing two fluids, and particularly for intermixing with a first fluid of a relatively high volume, a second fluid of a relatively low volume. Also, it will be appreciated that the principles of this invention which have been discussed above and which are hereinafter discussed could be utilized in other proportioners and mixers for a varying number of fluids and in a varying number of environments and circumstances. Accordingly, the following detailed description is for the purpose of describing a preferred embodiment of the proportioner without limiting the scope of the invention.

The proportioner 10 preferably comprises an integral proportioner body 20. As viewed in FIG. 2, the upper end of the proportioner includes an integral fitting means 21, which in this case includes internal threads for the purpose of securing the proportioner onto a faucet or conduit 11. Other fittings or fitting configurations could be used.

Figure 2:
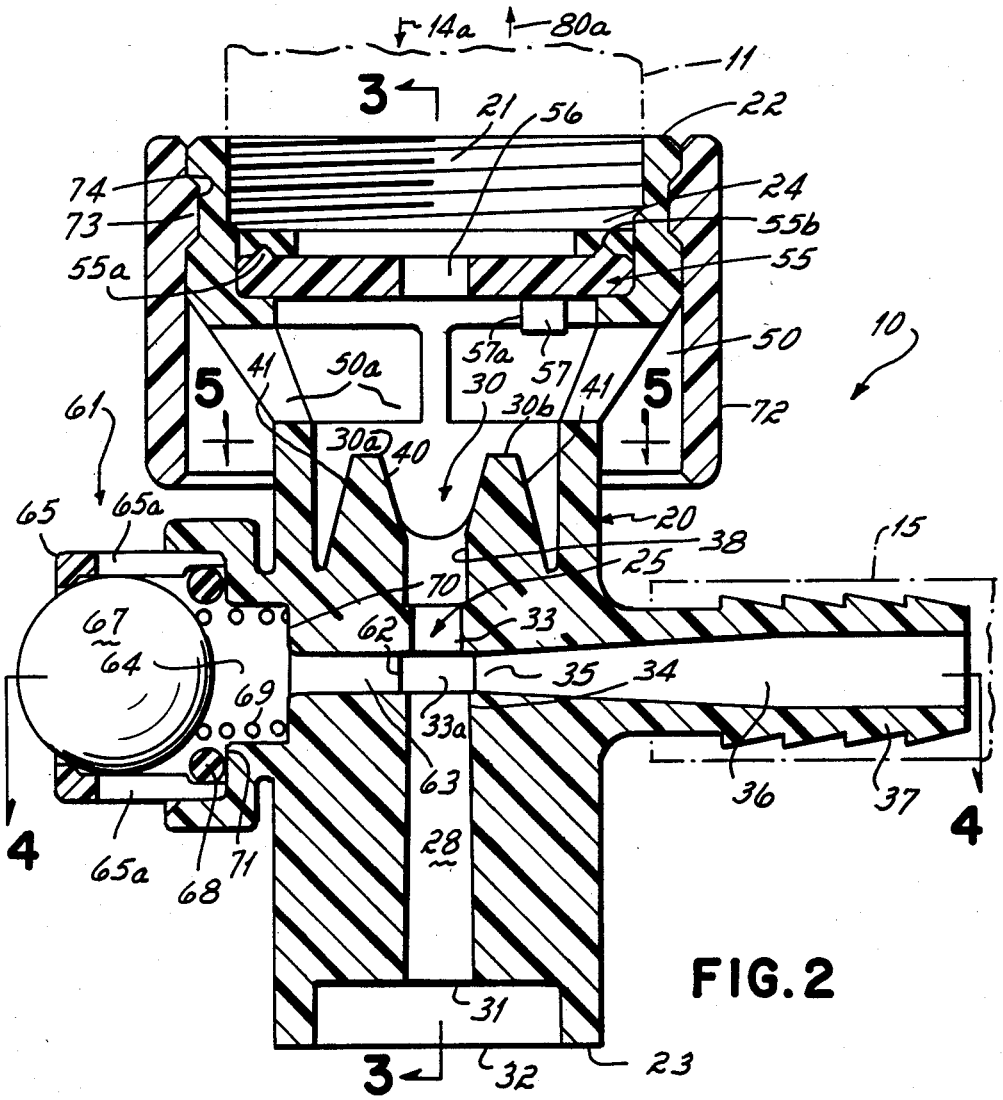
FIG. 2 is a cross-sectional view of the proportioner of FIG. 1.

It will be appreciated throughout this description that the flow of the water through the proportioner 10 is in the direction of the arrow 14a as shown in FIG. 2. Thus, the proportioner has an upstream end 22 and a downstream end 23. The fitting 21 is disposed at the upstream end of the proportioner.

Immediately downstream of the fitting means 21 is provided an intake or first chamber 24. When the proportioner is connected to the faucet 11 and the water supply 13, water is supplied under pressure to the intake or first chamber 24.

Formed integrally with the proportioner body 20 is a venturi means 25. Venturi means 25 includes walls 26 and 27, surrounding and defining an elongated, outwardly tapering venturi passage 28 which is preferably concentric about an elongated venturi axis 29 disposed parallel with the flow of water through the proportioner 10. Axis 29 is also preferably the central elongated axis of body 20.

The venturi has a mouth 30 and a discharge outlet 31 downstream of the mouth 30. Discharge outlet 31 of the venturi is disposed slightly upstream of the discharge outlet 32 of the proportioner 10. It will be further appreciated that the elongated venturi passageway 28 is substantially circular in crosssection, however, such passageway has a reduced passageway 33 and an abruptly opening wider passageway 34 at an upstream position in the venturi. The transition from passageway 33 to passageway 34 is via a rectangular space **33*a* as shown in the drawings. Located in the interior wall of the venturi 25, and particularly in communication with rectangular space 33*a* is a port or opening 35 in communication with a passageway 36 located in a fitting 37 which is formed integrally with the proportioner body 20. Fitting 37 is designed for receipt of a conduit, such as conduit 15 (FIG. 1), connectable to a source 16** of a second fluid or liquid.

Figure 3:
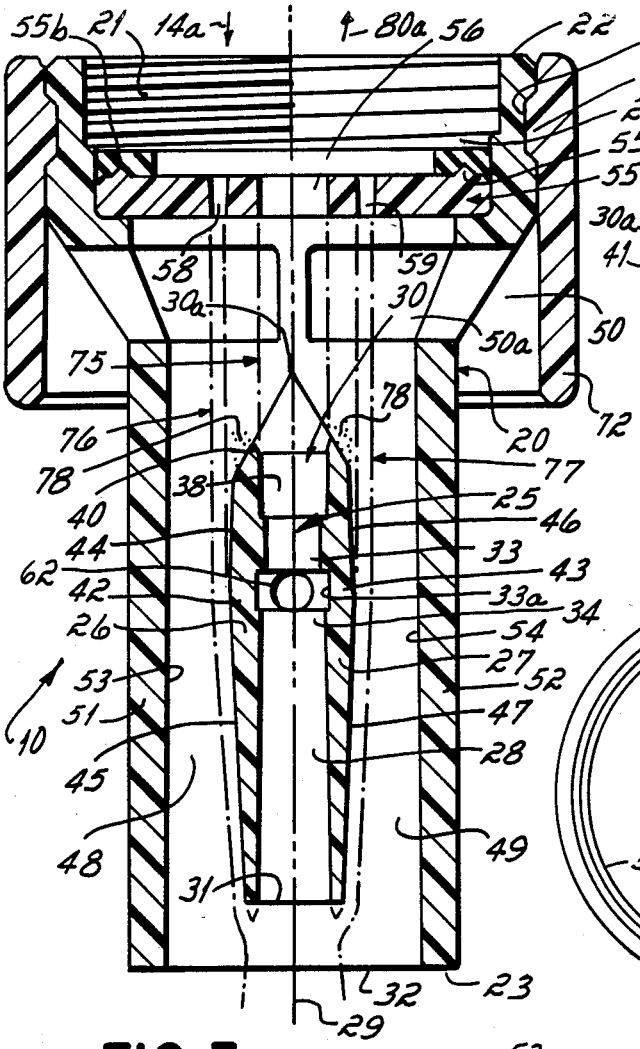
FIG. 3 is a cross-sectional view taken along lines 3—3 of FIG. 2.
Figure 5:
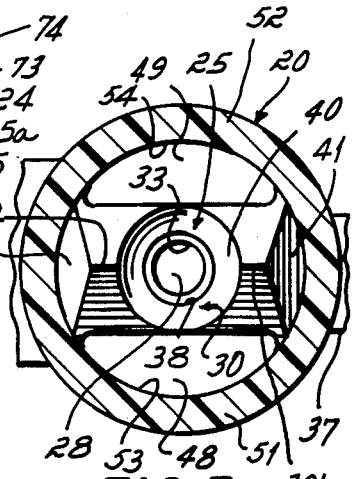
FIG. 5 is a cross-sectional view taken along lines 5—5 of FIG. 2.

The mouth 30 of the venturi includes a V-shaped taper, such as shown best in FIGS. 2 and 3. The mouth includes internal mouth walls 40 tapering inwardly to the reduced circular passageway 33 of the venturi. The upstream end of venturi means 25 and mouth 30 terminates in sharply defined peaks or apices **30*a* and 30*b* as shown. These peaks also define an upstream apex of triangular-shaped walls 41 which taper outwardly from peaks 30*a*, 30*b* to the interior walls of proportioner body 20. These sharp peaks aid in reducing splatter. Moreover, mouth 30 feeds into a first circular counter bore 38 which has a diameter greater than that of the reduced diameter passageway 33, and this tends to increase the velocity of any water in venturi 25 as the water runs through passageway 33 and rectangular area 33*a***.

With further attention to the venturi means 25, it will be appreciated that the walls 26 and 27 are of varied thickness. In particular, each of the walls has a thicker area 42, 43 and each of the walls tapers from the respective thick areas 42, 43 on exterior surfaces thereof in both upstream and downstream directions. Accordingly, wall 26 has an exterior surface 44 tapering in an upstream direction inwardly toward axis 29, and a downstream exterior surface 45 also tapering inwardly toward axis 29. Wall 27 has an upstream exterior surface 46 tapering in an upstream direction inwardly toward axis 29 and an exterior downstream surface 47 tapering inwardly toward axis 29 in a downstream direction.

The proportioner 10 includes an air chamber 50 disposed between the mouth 30 of the venturi 25 and the upstream end 22 of the proportioner body 20. Ports **50*a* which surround the air chamber 50 provide direct communication between chamber 50** and the atmosphere.

While the venturi is integrally formed with the body 20 as shown, there are located two respective passageways 48 and 49 between the exterior walls 26 and 27, respectively, of the venturi means and the exterior walls 51 and 52 which walls have interior circular surfaces 53 and 54, respectively. Passageways 48 and 49 communicate with air chamber 50 at their upstream end, and with discharge outlet 32 at their downstream end. Accordingly, it will be appreciated that the exterior walls of the venturi means 25 taper generally away from the interior walls 53 and 54 of the body 20.

Figure 6:
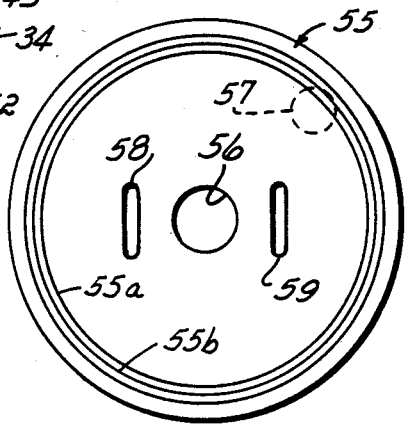
FIG. 6 is a plan view of the orifice defining plate of the invention.
Figure 4:
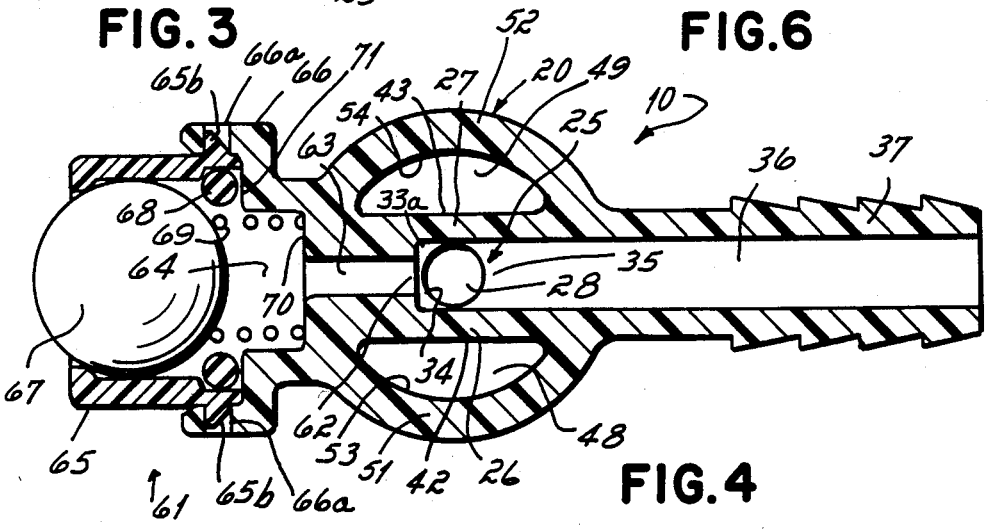
FIG. 4 is a cross-sectional view taken long lines 4—4 of FIG. 2.

A means for establishing a first stream from the first fluid, such as water is located between the intake or first chamber 24 and the air chamber 40. Such means preferably comprises an orifice defining plate 55, shown in cross-section in FIGS. 2 and 3 and in plan view in FIG. 6. An orifice 56 is located centrally in plate 55 for defining a first stream of water. The plate 55 is manufactured with a locating pin 57 for fitting within a detent or relief **57*a* cut into an interior wall of the body 20, for the purpose of positioning the orifice defining plate 55 in a particular angular relationship with respect to the proportioner 10 and the axis 29**.

The orifice defining plate 55 is also preferably provided with two slots, 58 and 59. These slots are utilized, as will be described, for establishing second and third streams, curtains or walls of water, parallel to the first stream of water running through the orifice 56 and according to the invention.

Plate 55 is also provided with a circular wall **55*a* terminating in an edge 55*b* extending from the plate in an upstream direction. A washer seal of yieldable material such as "BUNA-N" or rubber or any other suitable material seals against peak or edge 55*b* and against the interior walls of the proportioner body 20 to prevent leakage of water around plate 55**.

The proportioner 10 also includes means for the selective operation of the venturi means 25 for the purpose of drawing a second fluid or liquid into the proportioner. A selecting or control means 61 includes port 62 into the interior passage 34 of the venturi. Port 62 communicates via a passageway 63 with a chamber 64. A ball retainer 65 is disposed in a projection 66 formed integrally with the body 20. A ball 67 is captured in the removable retainer 65 for movement against a sealing O-ring 68 disposed in retainer 65. A spring 69 is seated on wall 70 of the projection 66 and urges the ball outwardly into engagement with the retainer 65. When the ball 67 is depressed, it engages the O-ring 68 which in turn engages seating surface 71 and thereby seals off the passageways 63 and 62 from the atmosphere. When the ball is in its extended position, as shown in FIG. 2, the passageway 63 and port 62 are open to atmosphere through appropriate openings **65*a* formed in the retainer 65. Retainer 65 includes yieldable snap-in latch projections 65*b* for fitting in detent 66*a* in projection 66**.

Moreover, proportioner 10 includes a circular sleeve, including a depending skirt 72 surrounding body 20 at its upstream end and preventing the inadvertent covering up of ports **50*a* by manipulation of an operator's hand, for example. Skirt 72 includes an internal annular projection 73 engaging a groove 74 in the body 20 of proportioner 10** for holding the skirt thereon.

Considering now a preferred operation of the proportioner 10, it will be appreciated that the proportioner is secured to a faucet such as faucet 11 which is turned on by movement of valve 12. When faucet 11 is turned on, water under pressure is supplied to the intake chamber 24 upstream of the orifice defining plate 55. That plate establishes preferably three distinct and independent streams or curtains of water. A first stream 75 is established by the orifice 56. Orifice 56 is preferably aligned with the mouth 30 of the venturi means 25 so that the stream of water 75 is received in the mouth 30 for passage through the venturi.

Slots 58 and 59 in the orifice defining plate 55 establish, respectively, second and third streams of water 76 and 77, running in a parallel direction to stream 75. When stream 75 moves toward the mouth 30, the major bulk of the stream 75 enters the mouth 30 and runs through the interior passageways 38, 33, 34 and 28 of the venturi 25. Some of the water in stream 75 may slightly disperse, as indicated by the diagrammatic droplets 78, or otherwise engage portions of the venturi mouth 30 and generate splash or splatter. Nevertheless, it will be appreciated that splash or splatter or droplets 78 are contained within the area of the venturi mouth 30 by means of the substantially surrounding streams or walls of water 76 and 77 formed by the slots 58 and 59 in plate 55. Accordingly, the second and third streams 76, 77 of water tend to capture, contain or entrain any splash or splatter occurring at the mouth 30 of the venturi.

As the first stream 75 runs through the venturi, it will be appreciated that it runs past the ports 35 and 62 (FIG. 2). Nevertheless, such water stream is ineffective to create a drawing vacuum at port 35 in view of the fact that port 62 is open to atmosphere. Accordingly, the low pressure created by the increased velocity of the water stream entering the mouth 30 of the venturi, and thence the reduced the passage 33, serves to draw only air into the stream 75.

When it is desired to intermix liquid detergent or sanitizer from source 16, for example, with the stream 75, an operator depresses the ball 67. Ball 67 engages the O-ring 68 and seats against the seal wall 71 of the projection 66 on the body 20. This cuts off the open passage to atmosphere from port 62 and essentially seals port 62. Upon this occurrence, a vacuum is drawn in rectangular area **33*a* and across port 35 by virtue of the high velocity water moving past that port. A vacuum is thus created in the conduit or passage 36, thereby drawing liquid from source 16 up into the venturi means 25. This second liquid is then mixed with the stream 75 of the first liquid water, and the two liquids are then carried through the passageway 28 of the venturi to the discharge outlet 31** of the venturi.

At the same time, the water streams 76 and 77 are flowing over the tapered exterior wall surfaces 44, 45 and 46, 47 of the venturi, respectively. Due to the tapering shape of these walls both in an upstream and downstream direction in a form similar to that of an air foil, and the fact that the streams 76 and 77 were moving at the same initial velocity as the stream 75, the velocities of the streams 76 and 77 are increased with respect to that of the stream 75. At the outlet 31 of the venturi, the streams 76 and 77 are combined with the first stream 75, forming a combined stream which is then discharged, together with any second liquid therein, through the unobstructed discharge outlet 32.

It has been discovered that the combination of the increased velocity streams 76 and 77 with the first stream 75 tends to increase the efficiency of the venturi and particularly that of the first stream 75 to draw a second liquid through the passage 36 and the port 35. Accordingly, the efficiency of the venturi in drawing a second liquid therein and in intermixing it with the first liquid or water is increased.

Applicant does not fully understand the specific reasons as to why the combination of the streams 76 and 77 with the stream 75 has this effect. Applicant has observed that without the streams 76 and 77, the venturi action of the stream 75 and its efficiency in drawing a second liquid through the port 35 is effectively decreased. Applicant surmises that the combination of the streams somehow either creates a back pressure within the venturi, or induces an even further vacuum within the venturi which increases the draw on the liquid through the passage 36 and port 35.

Applicant has also discovered that with this particular construction it is unnecessary to utilize a screen or perforated plate at the discharge outlet 32 of the proportioner 10. Instead, the discharge outlet can be unobstructed, as shown in FIG. 3, and there is nothing downstream of the venturi outlet which may clog or retain some amounts of chemical, such as a detergent or sanitizer, for example.

Of course, it will be appreciated that the shapes of the slots 58 and 59 or the shape of the orifice 56 may be varied for differing configurations, but it will be appreciated that the streams 76 and 77 issuing from the slots 58 and 59 constitute a wall or curtain of water on each side of the venturi mouth 30, thereby effectively capturing and entraining any splash or splatter or excess flow occurring from the stream 75 as it moves across the air chamber 50 and through mouth 30 into the venturi means 25.

It will also be appreciated that when the proportioner 10 is utilized with a first liquid supply system which may be subjected to transient vacuum conditions, the proportioner provides a vacuum break which will prevent the inadvertent suction of chemicals from the proportioner into the faucet or conduit 11. In particular, upon the occurrence of a vacuum it will be appreciated that there will be no water flowing downstream in the direction of arrow 14*a*, but rather a negative pressure in a direction of the arrow 80 as shown in FIG. 1 and 80*a* as shown in FIGS. 2 and 3. Accordingly, there would be no flowing streams 75, 76 or 77.

Since air chamber 50 is open to atmosphere through ports or windows 50*a*, and beneath skirt 72, only air is drawn back through plate 55 and into the intake chamber 24 and any faucet or conduit 11. Also, it will be appreciated that the passageways 48 and 49 are open at their downstream ends at the discharge outlet 32 of the proportioner body 20. These passageways, as shown in FIG. 3, operatively communicate with the air chamber 50 and through the orifice 56 and slots 58 and 59 with the intake chamber 54. Accordingly, any negative pressure existing in the intake chamber 24 will simply only pull atmospheric pressure from the discharge outlet 32 of the body 20 into the proportioner and thence into the conduit or faucet 11. Since there is no liquid flow through the venturi means 25, no chemical or second liquid will be drawn through the conduit 36 or port 35 in a direction corresponding to that of arrow 80*a*. Thus, the proportioner provides a vacuum break which will automatically prevent the inadvertent injection or suction of an undesirable liquid or chemical into the supply system of the first liquid.

Having now fully described a preferred embodiment of the invention, it will be appreciated that other modifications and advantages will become readily apparent to those of ordinary skill in the art and applicant intends to be bound only by the claims appended hereto.

We claim:

1. In a vacuum break, fluid proportioner of the type having an intake chamber, an air chamber open to atmosphere, a venturi, and an orifice between the intake chamber and the venturi for directing a first stream of a first fluid across the air chamber into the mouth of said venturi, an improvement for reducing splatter of said first stream at said venturi mouth, said improvement comprising:

means upstream of said mouth for defining at least one second stream of said first fluid and for directing said second stream alongside said mouth outwardly thereof and spaced therefrom to capture and entrain into said second stream splatter from said first stream occurring adjacent to said second stream and proximate said mouth.

2. The improvement of claim 1, further including means defining a third stream of said first fluid on an opposite side of said mouth to capture other splatter from said first stream at said mouth.

3. The improvement of claim 2, wherein said second and third streams rejoin said first stream downstream of said venturi means.

4. The improvement of claim 3, further including a single, unobstructed discharge opening from said proportioner for said combined streams.

5. The improvement of claim 4, wherein said venturi means comprises a venturi body disposed within said proportioner and having exterior walls in part spaced from said proportioner and defining passages for said second and third streams through said proportioner adjacent said venturi exterior walls.

6. The improvement of claim 5, wherein said exterior venturi walls are tapered inwardly in both upstream and downstream directions to increase the velocity of said second and third streams with respect to said first stream.

7. In a vacuum breaking proportioner having means for defining a first stream from a first fluid for introduction into the mouth of a venturi to draw a second fluid thereto, the improvement comprising means upstream of said mouth for establishing at least one dual purpose second stream directed alongside said mouth outwardly thereof and spaced therefrom for capturing and entraining splatter from said first stream occurring adjacent said second stream and proximate said mouth of said venturi, and for combining with said first stream at a discharge end of said venturi to improve the efficiency of said venturi in drawing said second fluid.

8. A proportioner for intermixing a first fluid with a second fluid of lower volume than the first fluid and including:

a proportioner body having exterior and interior walls, an intake opening and a discharge opening;

a first chamber for receiving a first fluid under pressure through said intake opening;

an air chamber;

a venturi means disposed in said body downstream of said first chamber and of said air chamber, said venturi means having a mouth for receiving said first fluid, an elongated venturi passage for said first fluid extending downstream from said mouth, and exterior walls;

said venturi means also including a port means opening into said elongated passage, said port selectively connectable to a source of said second fluid;

at least one fluid passageway disposed between an interior wall of said proportioner body and an exterior wall of said venturi means, said fluid passage having a downstream portion terminating at said open downstream discharge opening in said proportioner body and an upstream portion in communication with said air chamber and said first chamber;

said elongated venturi passage having an open downsteam outlet in operative communication with said downstream outlet in operative communication with said downstream portion of said fluid passageway;

means for directing a first stream of a first fluid from said first chamber across said air chamber and into said venturi mouth for passage through said elongated venturi passage, and for reducing pressure across said port to draw a second fluid therethrough into said first fluid; and means for establishing at least a second separate and independent stream of said first fluid and for directing said second stream across said air chamber and into said fluid passageway adjacent and outwardly of said mouth for reducing splatter from said first stream occurring near said venturi mouth, and adjacent said second stream.

9. A proportioner as in claim 8, wherein said elongated venturi passage outlet is disposed upstream of said discharge opening in said proportioner body.

10. A proportioner as in claim 9, wherein said fluid passageway is open to atmosphere at said discharge end when no first or second fluid is directed through said proportioner, thereby providing a connection between atmosphere and said first chamber.

11. A proportioner as in claim 9, wherein when a first fluid is introduced to said proportioner under pressure, said first and second fluid streams join together at the venturi outlet, thereby increasing the efficiency of said venturi means in drawing said second fluid through said port into said first fluid.

12. A proportioner as in claim 11, wherein said venturi means has an exterior wall having a cross-section which is enlarged between said venturi mouth and said outlet such that said exterior wall of said venturi means tapers inwardly, toward said elongated venturi passage, from a position intermediate said mouth and said outlet in both an upstream and a downstream direction.

13. A proportioner as in claim 12, wherein the velocity of said second stream along an exterior wall of said venturi means is greater than the velocity of said first stream in said elongated venturi passage.

14. A proportioner as in claim 13, wherein said discharge end of said proportioner body is unobstructed.

15. A proportioner as in claim 8, including two fluid passageways in said body, separated in part by said venturi means, wherein said means for establishing a second stream of said first fluid establishing a second stream of said first fluid established also a third stream of said first fluid, said second and third streams moving alongside said first fluid stream, and flowing on each side of said mouth for entraining any splatter from said first stream and for respectively passing through said fluid passageways on opposite sides of said venturi means to join said first stream downstream of said venturi means.

16. A proportioner as in claim 15, wherein said fluid passageways communicate said first chamber to atmosphere when a first fluid is not passing therethrough.

17. A proportioner as in claim 8, wherein said means for directing said first stream comprises a member defining an orifice disposed between said venturi mouth and said first chamber and said member further defining said means for establishing said second stream.

18. A proportioner as in calim 17, wherein said means for establishing said second stream comprises at least one additional opening through said member adjacent said orifice.

19. A method for mixing two separate fluids in a proportioner and comprising the steps of:

defining a first stream from a first fluid and directing said first stream into the mouth of a venturi means having a port connected to a second fluid for drawing said second fluid into said first fluid stream;

defining at least one second stream from said first fluid and directing said second stream of said first fluid adjacent but outwardly of and spaced from said mouth and along an exterior wall of said venturi means; and entraining within said second stream fluid dispersing from said first stream proximate said venturi mouth and adjacent said second stream, said second fluid stream combining with said first fluid stream, and said second fluid therein, downstream of said venturi means.

20. The method of claim 19, further including the steps of discharging said combined streams from said proportioner.

21. A method as in claim 19, including the step of generating back pressure in said venturi means by recombining said two streams downstream of an outlet from said venturi means.

22. A method as in claim 19, including the further step of increasing the velocity of said second stream exterior of said venturi means with respect to the velocity of a first stream therein.

23. A method as in claim 19, including the step of establishing said first and second streams from said first fluid in an orifice defining plate disposed upstream of said venturi mouth.

24. A method as in claim 19, further including the step of preventing backflow of fluids through said venturi means by opening an intake end of said proportioner to the atmosphere through a passageway for said second stream.

* * * * *